US007815115B2

(12) United States Patent
Rothe et al.

(10) Patent No.: US 7,815,115 B2
(45) Date of Patent: Oct. 19, 2010

(54) METHOD OF DETERMINING A FIRE GUIDANCE SOLUTION

(75) Inventors: Hendrik Rothe, Barsbüttel (DE); Sven Schröder, Kassel (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 328 days.

(21) Appl. No.: 11/577,849

(22) PCT Filed: May 15, 2006

(86) PCT No.: PCT/DE2006/000836

§ 371 (c)(1),
(2), (4) Date: Apr. 24, 2007

(87) PCT Pub. No.: WO2006/122527

PCT Pub. Date: Nov. 23, 2006

(65) Prior Publication Data

US 2009/0212108 A1 Aug. 27, 2009

(30) Foreign Application Priority Data

May 17, 2005 (DE) ..... 10 2005 023 739

(51) Int. Cl.
*G06F 19/00* (2006.01)

(52) U.S. Cl. ..... 235/404; 235/407

(58) Field of Classification Search ..... 235/404, 235/405, 406, 407

See application file for complete search history.

(56) References Cited

U.S. PATENT DOCUMENTS 4,128,837 A 12/1978 Page
4,148,026 A 4/1979 Gendreu
6,973,865 B1 * 12/2005 Duselis et al. ..... 89/41.05

FOREIGN PATENT DOCUMENTS

EP 0 329 524 12/1993
GB 2 254 405 7/1992

OTHER PUBLICATIONS

Einführung in die Numerische Mathematik II, textbook excerpt.

* cited by examiner

*Primary Examiner*—Karl D. Frech
(74) *Attorney, Agent, or Firm*—Robert W. Becker; Robert Becker & Associates

(57) ABSTRACT

A method of determining a firing guidance solution when relative movement exists between a projectile-firing weapon and a target object that is to be hit, including the steps of adjusting the weapon in azimuth angle and elevation angle, by means of a movement differential equation solution method determining a projectile point of impact and flight times at prescribed azimuth and elevation angle values in view of the ammunition used and external influences, varying the azimuth and elevation angles, as input parameters of the movement differential equation solution method, until a firing guidance solution is found, taking into consideration the weapon and target object speeds, providing a function J ($\alpha$, $\epsilon$) that assumes a particular value J* when the azimuth and elevation angles represent a firing guidance solution, and selectively iteratively varying the azimuth and elevation angles using mathematical processes such that the particular value J* is found.

14 Claims, 2 Drawing Sheets

METHOD OF DETERMINING A FIRE GUIDANCE SOLUTION

BACKGROUND OF THE INVENTION

The present invention relates to a method of determining a fire guidance or control solution when a relative movement exists between a weapon that fires a projectile, and which is movable in azimuth and elevation, and a target object that is to be hit or struck.

The fire guidance solution refers to the pairs of values of azimuth angle $\alpha$ and elevation angle $\epsilon$ that are to be set and with which the projectile point of impact coincides adequately precisely with the location of the target object at the same point in time after the projectile flight time.

The starting point of the invention is the difficulty of determining the point of impact and the flight time of a projectile that has been fired from a weapon that is movable in azimuth and elevation, i.e. of solving the so-called movement differential equations of the extra ballistic. In this connection, the projectile point of impact and the projectile flight time depend not only on the azimuth angle and elevation angle that have been set, but also upon the ammunition used and further influences, such as the wind or the temperature. Due to the number and uncertainty of the parameters, it is generally not possible to calculate the projectile point of impact and the projectile flight time. For this reason, various movement differential equation solution methods are used, such as, for example, the numeric integration, the use of firing diagrams, or approximations. Of particular prominence is the NATO Armaments Ballistic Kernel (NABK), which, using the input-parameters such as azimuth angle, elevation angle, ammunition and weather data determines the flight path of the projectile as a function of time [x(t), y(t), z(t)].

The methods mentioned deliver good results, but only for the case where neither the weapon nor the target object moves. If the weapon moves, the projectile flight path is influenced by this movement. If the target object moves, it can happen that after the projectile flight time the target object is already no longer at the projectile point of impact.

Up to now, the firing guidance solution is determined in the indirect or direct aiming and in the presence of a relative movement between the weapon and the target object in such a way that a plurality of pairs of values are provided for the azimuth and elevation. For these values, the movement differential equations are then solved by the methods of the state of the art until the firing guidance solution is found. The drawback for proceeding in this manner is that a plurality of pairs of values must be provided or prescribed for azimuth and elevation until a firing guidance solution is found. The calculation time thus required for the frequent solution of the movement differential equations makes a practical use of the firing with this method more difficult when an arbitrary relative movement is present between the weapon and the target option.

It is an object of the present invention, white solving the movement differential equations as few times as possible, to determine a firing guidance solution in the indirect or direct aiming and in the presence of an arbitrary relative movement between the weapon and the target object.

SUMMARY OF THE INVENTION

The realization of this object is effected pursuant to the invention by the steps of adjusting the weapon in azimuth angle and elevation angle, by means of a movement differential equation solution method determining a projectile point of impact and flight times at prescribed azimuth and elevation angle values in view of the ammunition used and external influences, varying the azimuth and elevation angles, as input parameters of the movement differential equation solution method, until a firing guidance solution is found, taking into consideration the weapon and target object speeds, providing a function J ($\alpha$, $\epsilon$) that assumes a particular value J* when the azimuth and elevation angles represent a firing guidance solution, and selectively iteratively varying the azimuth and elevation angles using mathematical processes such that the particular value J* is found.

To realize the object, the method can advantageously include the following features:

In the particular points of the weapon and of the target object, a coordinate system is respectively fixed ($KS_{weapon}$, $KS_{target}$).

When the projectile leaves the barrel, the time t is set to an arbitrary but fixed value $t_{fix}$, for example $t_{fix}=0$.

When the projectile leaves the barrel, the position vector of the projectile $r_{projectile}$ is set to an arbitrary yet fixed value $r_{fixed}$. For example $r_{fixed}=0$.

The coordinate system $KS_{weapon}$ is set to the spatially fixed initial system I* for the determination of the firing guidance solution.

The speed vector of the tube aperture $v_M$ at the point in time $t=t_{fix}$ is added to the speed vector $v_0$ in the direction of the weapon tube bore axis: as a result of which the new initial speed $v_0$* is provided. The movement of the target object, represented by $KS_{target}$, is determined relative to I*, as a result of which not only a position vector of the relative movement $r_{rel}$, but also a time dependent vector of the relative speed $v_{rel}$ relative to I* is provided.

The vector determined relative to I* of the absolute wind speed $v_W$ undergoes, via the known vector of the relative movement $v_{rel}$ between weapon and target object for the ballistic calculations, a suitable correction, as a result of which a vector of the corrected wind speed $v_{Wcorr}$ is provided.

A function J ($\alpha$, $\epsilon$) that is dependent upon the azimuth angle $\alpha$ and the elevation angle $\epsilon$ is constructed that assumes a particular value J*, for example a minimum, a maximum or zero, when after the flight time $t_{flight}$ the time-dependent position vectors of projectile and target object $r_{projectile}$ and $r_{rel}$, which are determined relative to I*, coincide with one another in an adequately precise manner.

Using suitable mathematical methods, the particular value J* of J ($\alpha$, $\epsilon$) is found by as few solutions of the movement differential equations of the extra ballistic as possible.

BRIEF DESCRIPTION OF THE DRAWINGS

One possible embodiment of the invention is illustrated in FIGS. 1 and 2, in which.

DESCRIPTION OF PREFERRED EMBODIMENTS

Figure 1:
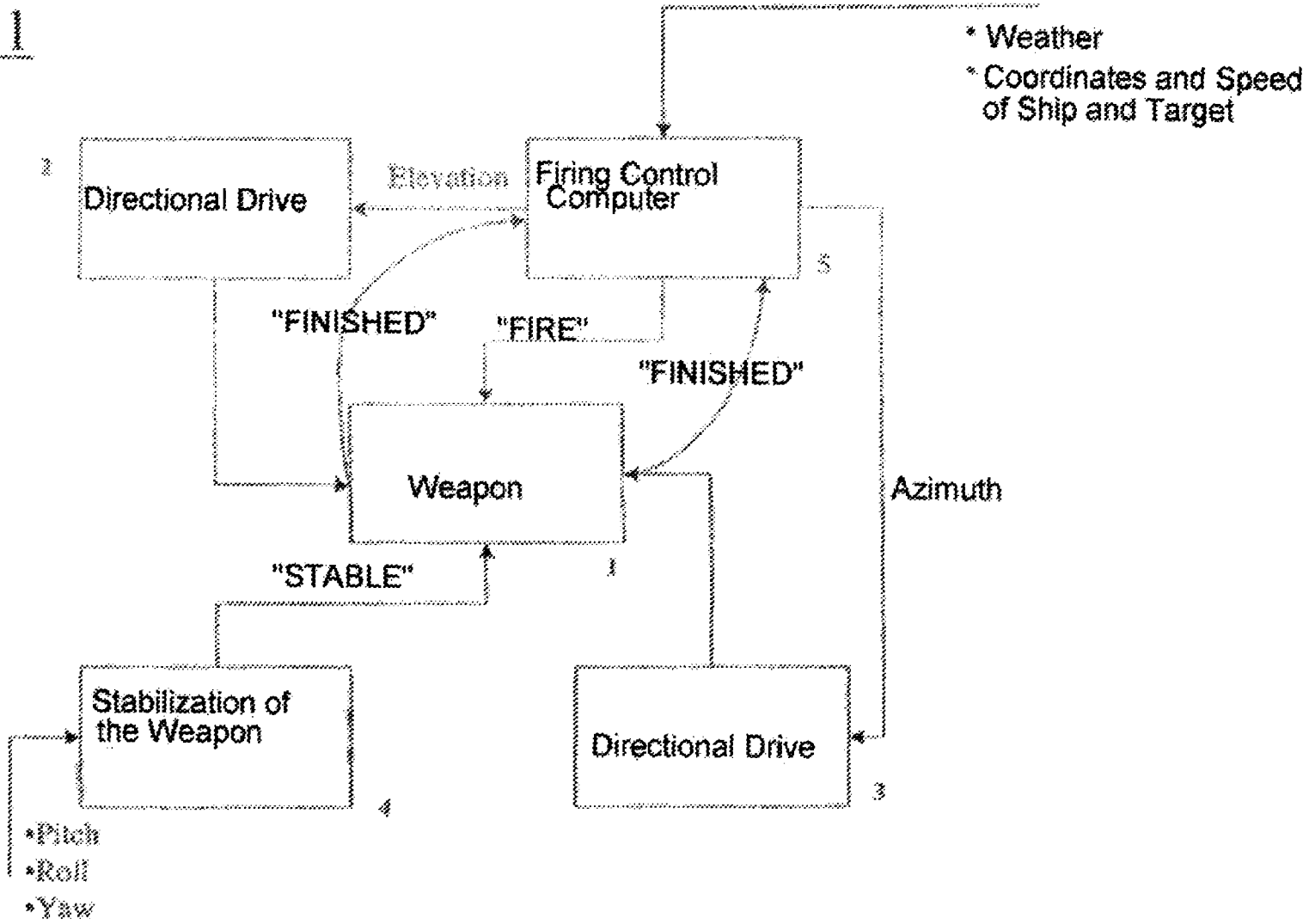
FIG. 1: shows a schematic illustration of a weapon system.

FIG. 1 schematically illustrates a weapon system, such as is used, for example, on a ship, in addition to the weapon 1, it is provided with an elevation-directional drive 2 and an azimuth-directional drive 3, as well as means 4 to stabilize the weapon. The weapon system is furthermore provided with a firing control computer 5 that controls components of the weapon system. The firing control computer 5 has, among others, the object of determining the firing guidance or control solution, i.e. to determine the values for the azimuth and the elevation angle in such a way that the target object will be hit or struck. The process of determining the firing guidance solution is described in FIG. 2. In the following, the assumption is made that the command to fire was given by a responsible person, and the weapon 1 was loaded.

The object of the means 4 to stabilize the weapon is to compensate for the influences of the values of pitch, roll and yaw, which are measured by suitable sensors and are caused by swells or the motion of the ship.

When the weapon 1 is stabilized, a signal "STABLE" is generated and the alignment or aiming process can begin by means of the elevation-directional drive 2 and the azimuth-directional drive 3. When the elevation-directional drive 2 and the azimuth-directional drive 3 have achieved the values for elevation and azimuth prescribed by the firing control computer 5, they provide the signals "FINISHED" to the firing control computer. Although the pre-selected point in time for the extra-ballistic calculations is the value t=0, for reasons of simplicity, at the point in time of giving of the command to fire by the responsible person it is so far in the future that there is sufficient time for determining the values for azimuth and elevation, the aiming of the weapon 1, and if necessary for the stabilization.

Figure 2:
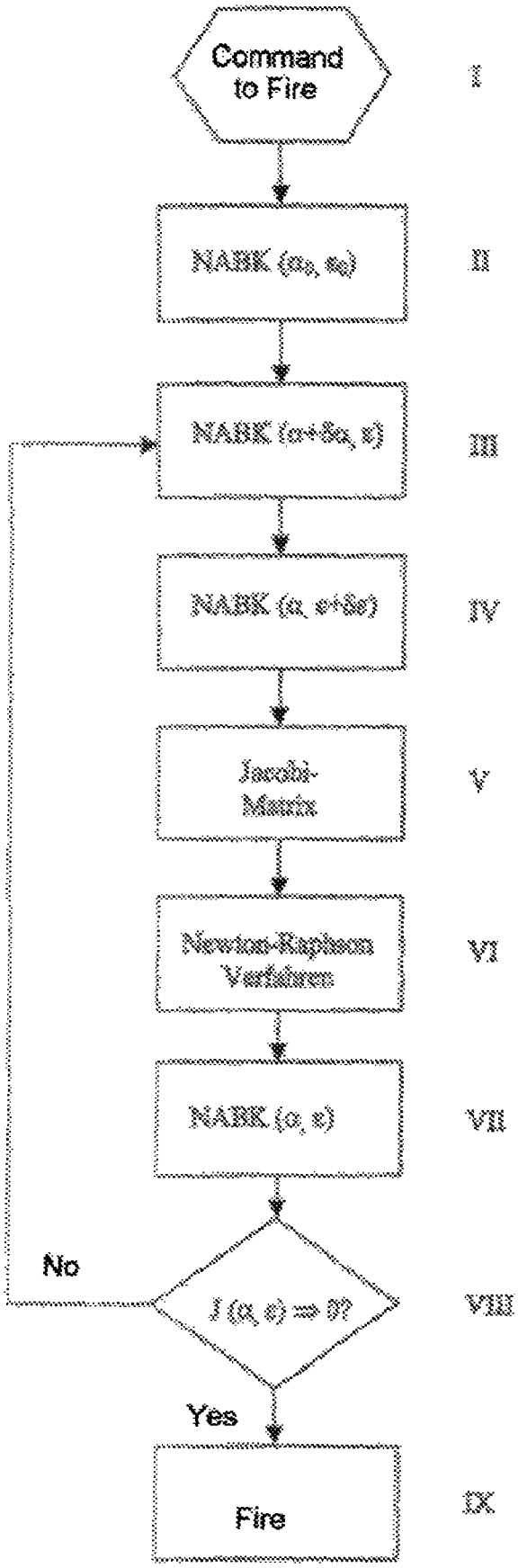
FIG. 2: is a flow or block diagram for the determination of the firing guidance or control solution.

The processes that take place in the firing control computer 5 after the command to fire has been given are illustrated in FIG. 2. Before starting to solve the movement differential equations of the extra ballistic by the NATO Armaments Ballistic Kernel (NABK) (Release 6.0) via numeric integration, the following limiting conditions are established:

As movement differential equations of the extra ballistic, those of the modified point mass trajectory model are used (pursuant to NATO STANAG 4355).

The origin of the coordinate system $KS_{weapon}$ is fixed in the center point of the tube aperture of the weapon.

The origin of the coordinate system $KS_{Target}$ is fixed in the desired point of impact.

When the projectile leaves the barrel, the time t is set to the fixed value $t_{fix}=0$.

When the projectile leaves the barrel, the position vector of the projectile is set to the fixed value $r_{projectile}=0$.

The speed vector of the tube aperture $v_M$ at the point in time $t_{fix}=0$ is added to the speed vector $v_0$ in the direction of the weapon tube bore axis, as a result of which the new initial speed $v_0^*$ is provided. The speeds $v_M$ and $v_0$ are determined by suitable technical means and are to be regarded as known.

The movement of the target object, represented by $KS_{Target}$, is determined relative to I*, as a result of which not only a position vector of the relative movement $r_{rel}$ but also a time-dependent vector of the relative speed $v_{rel}$ relative to I* are provided. The starting point $r_{rel}$ lies in the origin of I*, in other words in the center point of the tube aperture at the point in time $t_{fix}=0$.

The speed vector of the relative movement $v_{rel}$ at the point in time $t_{fix}=0$ is added to the speed vector of the wind speed $v_W$, as a result of which the corrected wind speed $v_{Wcorr}$ is provided. The determination of the speed $v_{rel}$ can be effected by a doppler radar or optronic sensors. The determination of the speed $v_W$ can be effected by suitable weather sensors.

Since I* represents a cartesian coordinate system having the axes (x, y, z), and after the projectile flight time $t_{flight}$ the vectors $r_{projectile}$ and $r_{rel}$ within the system I* are the same, the results:

$$x_{projectile}(t_{flight})=x_{rel}(t_{flight})$$

$$y_{projectile}(t_{flight})=y_{rel}(t_{flight})$$

$$z_{projectile}(t_{flight})=z_{rel}(t_{flight})$$

Since only the two variables azimuth $\alpha$ and elevation $\epsilon$ are available, a third variable, namely the projectile flight time $t_{flight}$, is required in order to be able to solve the above equations. The solutions of the movement differential equations is thus continued until $z_{projectile}(t_{flight})=z_{rel}(t_{flight})$, or until the following is true with adequate precision:

$$\|z_{projectile}(t_{flight})-z_{rel}(t_{flight})\|\leqq\beta$$

where $\beta$ is a small positive value (altitude tolerance).

Thus, the projectile flight time $t_{flight}$ is no longer unknown, i.e. the system is no longer under determined.

A function J ($\alpha$, $\epsilon$) is constructed or designed from the azimuth angle $\alpha$ and elevation angle $\epsilon$ that assumes the particular value J* zero, when after the flight time $t_{flight}$ the time-dependent position vectors of projectile and target object $r_{projectile}$ and $r_{rel}$ determined relative to I*, coincide with one another in a sufficiently exact manner. This function is as follows:

$$J\begin{pmatrix}\alpha\\ \epsilon\end{pmatrix}=\begin{pmatrix}\tilde{x}(\alpha,\epsilon)\\ \tilde{y}(\alpha,\epsilon)\end{pmatrix}$$

where $$\tilde{x}(\alpha,\epsilon)=x_{projectile}(t_{flight})-x_{rel}(t_{flight})$$

$$\tilde{y}(\alpha,\epsilon)=y_{projectile}(t_{flight})-y_{rel}(t_{flight})$$

The values ($\alpha^*$, $\epsilon^*$) lead to a zero or null point of the function J ($\alpha$, $\epsilon$) and thus represent a fire guidance solution.

By suitable mathematical proceses, the particular value J* of J($\alpha$, $\epsilon$) is found by solving the movement differential equations of the extra ballistic as few times as possible. The Newton-Raphson method is used as the mathematical process for determining the zero point. For this purpose, the following equations are used:

$$\bar{J}=\begin{pmatrix}\frac{\partial\tilde{x}}{\partial\alpha} & \frac{\partial\tilde{x}}{\partial\epsilon}\\ \frac{\partial\tilde{y}}{\partial\alpha} & \frac{\partial\tilde{y}}{\partial\epsilon}\end{pmatrix}$$

$$\begin{pmatrix}\alpha\\ \epsilon\end{pmatrix}^{i+1}=\begin{pmatrix}\alpha\\ \epsilon\end{pmatrix}^{i}-\bar{J}_i^{-1}\begin{pmatrix}\tilde{x}\\ \tilde{y}\end{pmatrix}^{i}$$

$$\bar{J}^{-1}=\frac{1}{\left(\frac{\partial\tilde{x}}{\partial\alpha}\frac{\partial\tilde{y}}{\partial\epsilon}-\frac{\partial\tilde{x}}{\partial\epsilon}\frac{\partial\tilde{y}}{\partial\alpha}\right)}\begin{pmatrix}\frac{\partial\tilde{y}}{\partial\epsilon} & -\frac{\partial\tilde{x}}{\partial\epsilon}\\ -\frac{\partial\tilde{y}}{\partial\alpha} & \frac{\partial\tilde{x}}{\partial\alpha}\end{pmatrix}$$

FIG. 2 schematically shows a flow diagram; for determining a fire guidance solution after the command to fire [I] was given. First, the movement differential equations of the extra ballistic are solved by the NABK with initial values $\alpha_0$ for the azimuth angle and $\epsilon_0$ for the elevation angle [II]. The initial value $\alpha_0$ results from the position of weapon and target object, the initial value $\epsilon_0$ results from the ammunition that is used and the distance between weapon and target object. The values determined for the projectile point of impact and the projectile flight time are stored. Thereafter, a further integration of the movement differential equations is carried out by means of the NARK, whereby however the value of $\alpha$ is altered by a small value $\delta\alpha$[III]. The determined values of the projectile point of impact and of the projectile flight time are also stored. Subsequently, a further integration of the movement differential equations is carried out by means of the NABK, whereby however the value of $\epsilon$ is altered by a small value $\delta\epsilon$[IV]. The determined values of the projectile point of impact and of the projectile flight time are again stored. From the stored calculation results, it is possible to estimate the partial derivatives of the target coordinates $\tilde{x}$ and $\tilde{y}$ according to azimuth and elevation via a differential formula of the first order, which forms the Jacobi-matrix of the problem [V]. After the calculation of the inverse of the Jacobi-matrix, the Newton-Raphson step is carried out pursuant to the given equation [VI]. With the resulting new values for the azimuth angle $\alpha$ and for the elevation angle $\epsilon$, the movement differential equations are again solved by the NABK [VII]. The now determined projectile point of impact can be inserted into the function J to check whether a zero point, or at least an adequate approximation, was found [VIII]. If the value of the target function J is less than a prescribed value, for example 10 meters, for each coordinate $\tilde{x}$ and $\tilde{y}$, then a fire guidance solution is found [IX]. However, if the value is greater than the prescribed value for a coordinate $\tilde{x}$ or $\tilde{y}$, then a further iteration is carried out [III]-[VIII] until a firing guidance is found. Thus, in the first loop the movement differential equations of the extra ballistic must be solved four times; with each iteration, three times. It can be assumed that generally at most four iterations have to be carried out until a firing guidance solution is found, as a result of which the number of solutions of the movement differential equations amounts to a total of 16. Of course, a modern firing control or guidance computer actually needs only a short calculation time to accomplish this, so that by using the method it is possible to carry out the determination of a firing guidance solution in the presence of a relative movement between a weapon that fires a projectile and a target object that is to be hit.

The specification incorporates by reference the disclosure of German 10 2005 023 739.8 filed May 17, 2005 as well as PCT/DE2006/000836 filed May 15, 2006.

The present invention is, of course, in no way restricted to the specific disclosure of the specification and drawings, but also encompasses any modifications within the scope of the appended claims.

The invention claimed is:

1. A method of determining a firing guidance or control solution when a relative movement exists between a weapon adapted to fire a projectile and a target object that is to be hit, including the steps of:

adjusting the weapon in azimuth angle $\alpha$ and in elevation angle $\epsilon$;

by means of a movement differential equation solution method, determining a projectile point of impact and a projectile flight time at prescribed values for the azimuth angle $\alpha$ and the elevation angle $\epsilon$, and also in view of the ammunition used and taking into consideration external influences, especially weather data;

varying the azimuth angle $\alpha$ and the elevation angle $\epsilon$, as input parameters of the movement differential equation solution method, until a firing guidance solution is found, taking into consideration the speed of the weapon and the speed of the target object;

providing a function J ($\alpha$, $\epsilon$) that assumes a particular value J*, especially zero, when the azimuth angle and the elevation angle represent a firing guidance solution; and selectively iteratively varying the azimuth angle $\alpha$ and the elevation angle $\epsilon$ using mathematical processes, especially the zero-point searching method, such that the particular value J* is found.

2. A method according to claim 1, wherein said function J ($\alpha$, $\epsilon$) has the following form:

$$J\begin{pmatrix}\alpha\\ \epsilon\end{pmatrix}=\begin{pmatrix}\tilde{x}(\alpha,\epsilon)\\ \tilde{y}(\alpha,\epsilon)\end{pmatrix}$$

wherein:

$$\tilde{x}(\alpha,\epsilon)=x_{projectile}(t_{flight})-x_{rel}(t_{flight})$$

$$\tilde{y}(\alpha,\epsilon)=y_{projectile}(t_{flight})-y_{rel}(t_{flight})$$

wherein $x_{projectile}(t_{flight})$, $y_{projectile}(t_{flight})$: x- and y-coordinates of the projectile at projectile flight time $t_{flight}$.

$x_{rel}(t_{flight})$, $y_{rel}(t_{flight})$: x- and y-coordinates of the projectile at projectile flight time $t_{flight}$.

3. A method according to claim 2, which includes the further steps of using the iterative Newton-Raphson method as the mathematical process, and selectively varying the azimuth angle and the elevation angle $\epsilon$ according to the following equation:

$$\begin{pmatrix}\alpha\\ \epsilon\end{pmatrix}^{i+1}=\begin{pmatrix}\alpha\\ \epsilon\end{pmatrix}^{i}-\bar{J}_i^{-1}\begin{pmatrix}\tilde{x}\\ \tilde{y}\end{pmatrix}^{i}$$

with the Jakobi-matrix $$\bar{J}=\begin{pmatrix}\frac{\partial\tilde{x}}{\partial\alpha} & \frac{\partial\tilde{x}}{\partial\epsilon}\\ \frac{\partial\tilde{y}}{\partial\alpha} & \frac{\partial\tilde{y}}{\partial\epsilon}\end{pmatrix}$$

and $$\bar{J}^{-1}=\frac{1}{\left(\frac{\partial\tilde{x}}{\partial\alpha}\frac{\partial\tilde{y}}{\partial\epsilon}-\frac{\partial\tilde{x}}{\partial\epsilon}\frac{\partial\tilde{y}}{\partial\alpha}\right)}\begin{pmatrix}\frac{\partial\tilde{y}}{\partial\epsilon} & -\frac{\partial\tilde{x}}{\partial\epsilon}\\ -\frac{\partial\tilde{y}}{\partial\alpha} & \frac{\partial\tilde{x}}{\partial\alpha}\end{pmatrix}$$

4. A method according to claim 1, which includes the further steps of:

solving the movement differential equations solution method for an initial pair of values ($\alpha_0$, $\epsilon_0$);

solving the movement differential equations via the movement differential equation solution method for a pair of values ($\alpha'$, $\epsilon$), where $a'=\alpha+\delta\alpha$, in other words with an azimuth angle that is altered, especially slightly altered, relative to the previous step;

solving the movement differential equations via the movement differential equation solution method for a pair of values ($\alpha$, $\epsilon'$), with $\epsilon'=\epsilon+\delta\epsilon$, in other words with an elevation angle that is altered, especially slightly varied, relative to the previous step;

at least approximately determining the Jakobi-matrix;

using the Newton-Raphson method to deliver a new pair of values ($\alpha$, $\epsilon$);

solving the movement differential equations via the movement differential equation solution method for the new pair of values ($\alpha$, $\epsilon$); and checking whether a firing guidance solution was found, and if no firing guidance solution was found, continuing to iterate the method with the second step of this claim.

5. A method according to claim 1, which includes the step of enhancing the movement differential solution method by the NATO Armaments Ballistic Kernel.

6. A method according to claim 1, wherein in particular points of the weapon and the target object, a coordinate system and $KS_{weapon}$ and $KS_{target}$ is respectively fixed.

7. A method according to claim 6, wherein the coordinate system $KS_{weapon}$ is set to a spatially fixed initial system I*.

8. A method according to claim 7, wherein a movement of the target object, represented by $KS_{target}$, is determined relative to said initial system I*, as a result of which not only a position vector of the relative movement $r_{ref}$ but also a time-dependent vector of the relative speed $v_{ref}$ relative to I* is provided.

9. A method according to claim 7, wherein a vector of the absolute wind speed $v_W$ determined relative to said initial system I* undergoes, via a known vector of the relative movement $v_{ref}$ between the weapon and the target object for the ballistic calculations, a suitable correction, as a result of which a vector of the corrected wind speed $v_{Wcorr}$ is provided.

10. A method according to claim 1, wherein when a projectile leaves a weapon barrel, the time t is set to an arbitrary yet fixed value $t_{fix}$ especially $t_{fix}=0$.

11. A method according to claim 1, wherein when a projectile leaves the weapon barrel, the position vector of the projectile $r_{projectile}$ is set to an arbitrary yet fixed value $r_{fix}$, especially $r_{fix}=0$.

12. A method according to claim 1, wherein a speed vector of a tube aperture $v_M$ of the weapon at a point in time $t=t_{fix}$ is added to a speed vector $v_0$ in the direction of a weapon tube bore axis, as a result of which a new initial speed $v_0'$ is provided.

13. A method according to claim 1, wherein determination of the firing guidance solution is carried out using a firing guidance computer.

14. A method according to claim 13, wherein said firing guidance computer generates control signals via the firing guidance solution that is determined, and wherein said control signals are conveyed to a directional drive for azimuth and to a directional drive for elevation for a follow-up guidance of the weapon in azimuth and elevation.

* * * * *